United States Patent [19]

Solomon

[11] Patent Number: 4,893,225

[45] Date of Patent: Jan. 9, 1990

[54] COLOR CHANGER

[75] Inventor: Dennis Solomon, Yormouth Port, Mass.

[73] Assignee: Altman Stage Lighting Co., Inc., Yonkers, N.Y.

[21] Appl. No.: 163,742

[22] Filed: Mar. 3, 1988

Related U.S. Application Data

[63] Continuation-in-part of Ser. No. 939,348, Dec. 8, 1986, Pat. No. 4,811,182.

[51] Int. Cl.[4] ..... F21V 9/00

[52] U.S. Cl. ..... 362/293; 362/281; 362/324; 353/84

[58] Field of Search ..... 362/293, 268, 277, 280, 362/281, 282, 283, 284, 319, 321, 323, 324, 455, 456, 16, 18; 353/84, 88, 90; 350/311, 315, 316, 318

[56] References Cited

U.S. PATENT DOCUMENTS

| | | | |
|---|---|---|---|
| 1,591,211 | 7/1926 | Brenkert et al. | 362/281 |
| 1,766,637 | 6/1930 | Hopewell | 362/281 |
| 2,029,863 | 2/1936 | Earle | 362/293 |
| 2,151,735 | 3/1939 | Bresser | 353/84 |
| 2,856,831 | 10/1958 | Gipe et al. | 362/321 |
| 4,037,097 | 7/1977 | Stillman et al. | 362/324 |
| 4,208,100 | 6/1980 | Bischl | 362/281 |
| 4,468,720 | 8/1984 | Arai | 353/88 |
| 4,602,321 | 7/1986 | Bornhorst | 362/293 |

FOREIGN PATENT DOCUMENTS

| | | | |
|---|---|---|---|
| 687362 | 1/1940 | Fed. Rep. of Germany | 362/321 |
| 865490 | 5/1941 | France | 362/281 |

*Primary Examiner*—Ira S. Lazarus
*Assistant Examiner*—D. M. Cox
*Attorney, Agent, or Firm*—Lackenbach Siegel Marzullo & Aronson

[57] ABSTRACT

A color changer system mounted at the light beam emission end of a luminaire. The system includes a support frame secured to the housing and disposed transverse to the beam, a plurality of iris units each having a plurality of colored, translucent leaves rotatably attached to the support frame, and a circular control plate rotatably mounted to the support frame and having a control slot in which a thrust pin of each leaf is slidably movable and a control handle. The support frame and the control plate each have circular apertures with centers that are aligned with the beam axis. When the control plate is rotated, the leaves of each iris unit open or close in response to pressure against the thrust pin so as to control the coloring of the light beam. The leaves move inwardly from the periphery of the light beam towards the beam axis towards a closed position or move away from the beam axis so as to intercept all or a portion of the light beam to color the portion of the light beam passing through the intercepting leaves. The leaves of each iris unit each have a different color from the leaves of the other iris units, with the colors preferably including the primary colors of the spectrum. Mounting portions are connected to the rims of the translucent leaves. The leaves have inwardly extending walls that are aligned in the closed position of the system. The walls can be either linear or curved.

15 Claims, 5 Drawing Sheets

COLOR CHANGER

BACKGROUND OF THE INVENTION

This application is a continuation-in-part of an application entitled "Color Changer", Ser. No. 939,348, filed Dec. 8, 1986, now U.S. Pat. No. 4,811,182 issued Mar. 7, 1989.

FIELD OF THE INVENTION

This invention relates generally to spotlight systems and more particularly to a spotlight apparatus mounted with a spotlight for changing the colors of the spotlight beam.

BACKGROUND OF THE INVENTION

Spotlights are generally called upon to throw not only white, or colorless, beams but also color beams of varying colors, hues, and intensities that can be selected by an operator from a range of colors and color combinations across the complete range of the color spectrum.

One color changer mechanism known in the art uses a series of individually hinged color lenses, or boomerangs, each of a basic color of the light spectrum and hinged at the end of the spotlight housing so that any or any combination of the colored lenses can be rotated by an operator to a position at the emission end of the beam. The colors of the color lenses are such that the range of the spectrum is available. In the most elementary operation, the operator selects one color lens then rotates the selected lens across the light beam. In more complex operations, two or more selected color lenses, which when mated with one another will produce a desired color, can be rotated across the light beam. This type of mechanism is shown in a brochure entitled "Colortran" issued by Colortran, Inc., 1015 Chestnut Street, Burbank, CA, dated 5/84. One problem with this mechanism is that the color lenses must ride across the white or colored beam so that the changeover movement is not smoothly accomplished. Another problem is that the operator's hand must rotate a full half circle to accomplish the task of placing the selected color lens in front of the light beam. Yet another problem is that the lens being rotated in front of the light beam must be placed across the entire beam rather than just a part of the beam, since the lens is cutting into the beam from one side and a split colored-white beam is undesirable.

SUMMARY OF THE INVENTION

Accordingly, it an object of the present invention to provide a color changer system for a spotlight that can be easily operated to change the color of the light beam being projected in a subtle manner.

It is another object of this invention to provide a color changer system for a spotlight that moves the color being added to the light beam from the outer area of the beam towards the center of the beam.

It is still another object of the present invention to provide a color changer system for a spotlight that can be easily and quickly operated.

It is yet another object of the present invention to provide a color changer system for a spotlight that includes a plurality of iris valve units each of which closes a plurality of colored leaves from the periphery of the beam to the center of the beam or vice versa so that the beam can be colored gradually towards or decolorized from the center.

The present invention achieves the above objects by converting a shutter-type dimmer mechanism known in the art to a color changer system for a spotlight. Some prior patents of shutter mechanisms are listed below:

| Pat. No. | Date | Inventor |
|---|---|---|
| 1,049,554 | Jan. 7, 1913 | Wooden |
| 1,755,175 | Apr. 22, 1930 | Dina |
| 1,881,521 | Oct. 11, 1932 | Gstyr et al. |
| 2,307,273 | Jan. 5, 1943 | Hughes |
| 2,735,929 | Feb. 21, 1956 | Erhardt et al. |
| 3,621,766 | Nov. 23, 1971 | Giesecke |

The patent to Wooden especially has features that are used in the present invention.

The present invention includes a color changer system mounted at the light beam emission end of a luminaire housing. The system includes a support frame secured to the housing disposed transverse to the beam, a plurality of iris units each having a plurality of colored, translucent leaves rotatably attached to the support frame, and a circular control plate rotatably mounted to the support frame and having a control slot in which a thrust pin of each leaf is slidably movable and a control handle. The support frame and the control plate each have circular apertures with centers that are aligned with the beam axis. When the control plate is rotated, the leaves of each iris unit open or close in response to pressure by the control plate against a thrust pin so as to control the coloring of the light beam. The leaves move inwardly from the periphery of the light beam towards the beam axis towards a closed position or move away from the beam axis so as to intercept all or a portion of the light beam so as to filter the light beam through the intercepting leaves so as to color that portion of the intercepted beam. The leaves of each iris unit each have a different color from the leaves of the other iris units, with the colors preferably including the primary colors of the spectrum.

The present invention will be better understood and the objects and important features, other than those specifically enumerated above, will become apparent when consideration is given to the following details and description, which when taken in conjunction with the annexed drawings, describes, discloses, illustrates, and shows a preferred embodiment or modification of the present invention and what is presently considered and believed to be the best mode of practice in the principles thereof.

DESCRIPTION OF THE PREFERRED EMBODIMENT

Figure 1:
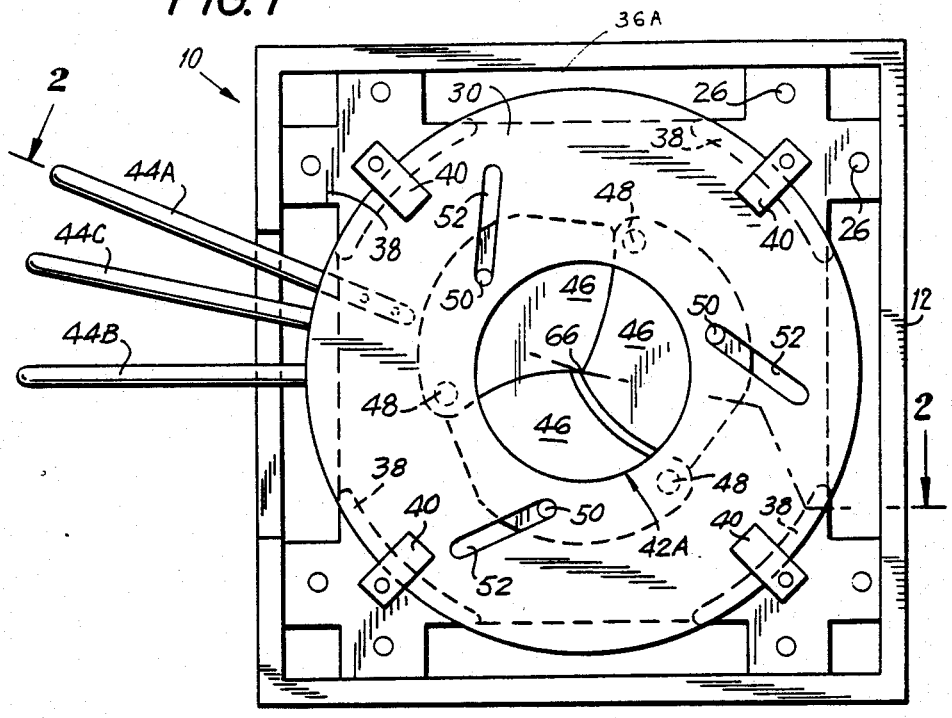
FIG. 1 is an elevational view of one side of the color changer system having four iris units with front and rear iris units in fully closed modes and two middle iris units in partly closed modes.
Figure 2:
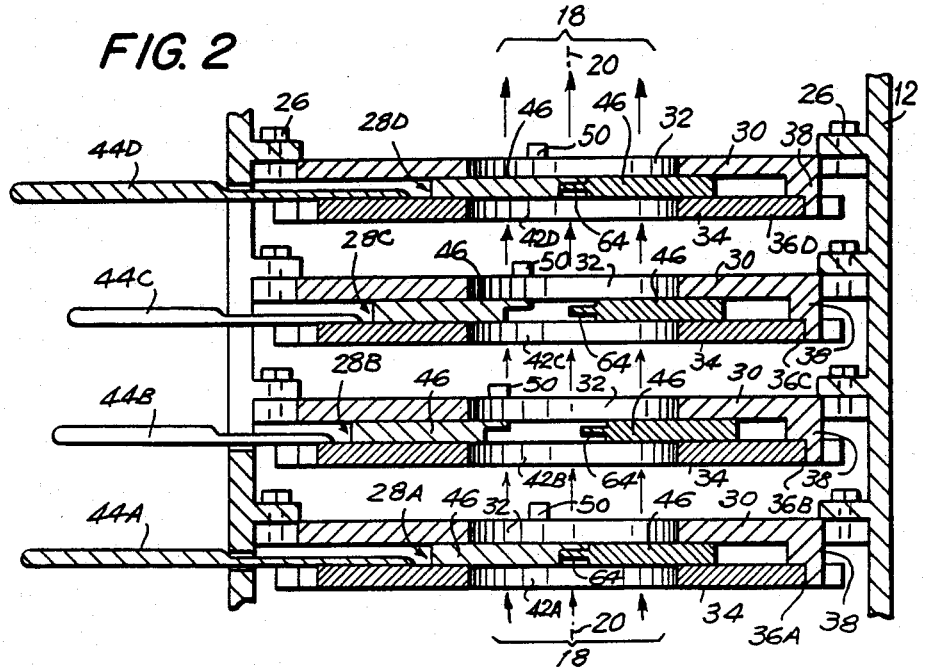
FIG. 2 is a sectional view taken through line 2—2 of FIG. 1.
Figure 3:
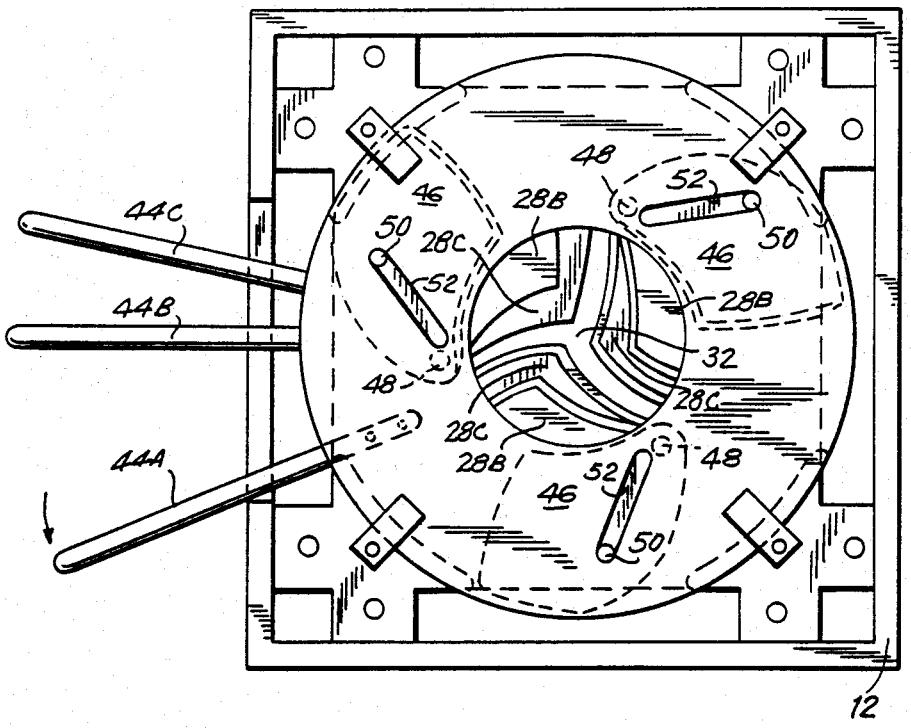
FIG. 3 is an elevational view of one side of the color changer system similar to FIG. 1 except that the front and rear iris units are in fully open modes.
Figure 4:
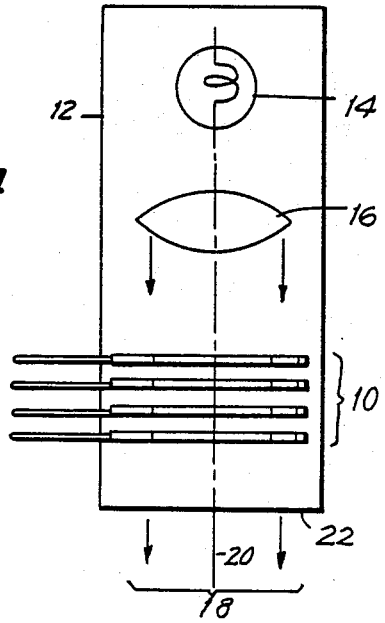
FIG. 4 is a simplified schematic view of the color changer system shown mounted in a luminaire.

A color changer system 10 is illustrated in isolation in FIGS. 1–3 and schematically mounted in a luminaire, or housing, 12 in FIG. 4. Housing 12 contains a light source 14 and a lens 16, but may include a number of other devices known in the art of stage illumination including an iris, a shutter, a mechanical dimmer, and an extended lens system. Light source 14 emits a light beam 18 centered about an axis 20. Beam 18 is emitted generally as a colorless, or white, beam and is directed to the beam emission end 22 of housing 12. A series of iris units 28A, 28B, 28C, and 28D each rotatably connected to its own generally flat support frame 30 are positioned perpendicular to beam 18 and secured to housing 12 at beam emission end 22 by a number of bolts 26 in a manner known in the art. Iris units 28A–28D are slightly spaced apart and parallel with one another with iris unit 28A nearest to entering beam 18 from light source 14 and iris unit 28D farthest. Each of the four support frames 30 has a circular aperture 32 having a center that is aligned with axis 20. Four flat control plates 34A–34D having reverse flat surfaces and circular circumferential edges 36A–36D are rotatably mounted parallel to each support frame 30 at four diametrically positioned arced, stepped support bosses 38 that extend from the beam- facing surface of each support plate 30. The first step of each arc of support bosses 38 is spaced from the beam-facing surface of support frame 30, so that a space is formed between each control plate 34A-34D and each support frame 30; iris units 28A–28D are positioned in the spaces so formed. Each control plate 34A–34D is rotatably positioned in the arcs of stepped supports 38 at circumferential edges 36A–36D so as to be freely rotatable laterally relative to each support frame 30 and iris units 28A–28D. Four hold-down members 40 have their one end screwed into each support frame 30 at stepped supports 38 and their opposite ends pressed against the beam-facing flat surface of each of control plates 34A–34D so as to keep each control plate rotatably mounted to each support frame 30. Each control plate 34A–34D has a respective central aperture 42A–42D of the same radius as aperture 32 of support frame 24 and having a center aligned with beam axis 20. Four control handles 44A–44D include hand gripping portions that extend outwardly from circumferential edges 36A–36D to connecting portions that are secured to control plates 34A–34D, respectively, by a pair of screws. The connecting portions of handles 44A–44D are disposed in the space between each iris unit 28A–28D and each support frame 30.

Each of the iris units 28A–28D includes three similarly shaped, colored or filtered, translucent iris leaves 46, which are centered about and disposed perpendicular to beam axis 20. A single iris leaf 46 is shown in isolation in FIGS. 5 and 6. Each leaf 46 is rotatably mounted to the beam-facing surface of support frame 24 by a pivot member 48, which is rotatably positioned in pivot holes in the beam-facing surface of support frame 24. A thrust pin 50 extends perpendicularly from the reverse surface from pivot member 48 of each leaf 46. Each control plate 34A–34D has an elongated control slot 52 in which a thrust pin 50 is engaged and slidingly movable along the slot as will be explained in detail below.

Leaves 46 of each set of iris units 28A–28D is colored differently from the other. As shown in FIGS. 1–3, the iris leaves 46 of iris unit 28A is of one primary color, he iris leaves 46 of iris unit 28B is of a second primary color, and the iris leaves 46 of iris unit 28C is of a third primary color. Leaves 46 of iris unit 28D are of a neutral, tinted shade that function to subdue the intensity of the colors of iris units 28A–28C.

Each of the iris units 28A–28D is movable between an open position and a closed position including a plurality of intermediate positions between the open and closed positions. In the open position beam 18 passes iris leaves 46, which are rotatably completely withdrawn from aperture 42 of support frame 30. In the closed position beam 18 passes through the three translucent leaves 46, which completely cover aperture 42 so that beam 18 is fully colored in accordance with the particular color of the leaves of the particular iris unit that is closed. In the plurality of intermediate positions leaves 46 of each iris unit are successively positioned across a portion of beam 18 and extend from the periphery of beam 18 to positions spaced from beam axis 20. As leaves 46 are simultaneously moved inwardly or outwardly, they close toward or from beam axis 20, respectively, so that an increasingly less or greater amount of light passes through the apertures centered around beam axis 20.

In operation an operator moves one of the control handles 44A–44D for its respective control plate 34A–34D and rotates the control plate by upward or downward movement of the control handle. For example, in FIGS. 1 and 2 control handle 44A is in a raised position and leaves 46 of iris unit 28A completely cover aperture 32 so that beam 18 is completely colored by the first primary color upon passing through translucent leaves 46. In FIG. 3 control handle 44A has been moved to a down position so that leaves 46 of iris unit 28A have been completely withdrawn from aperture 32 of its support frame 30 so that beam 30 is not colored as it passes iris unit 28A. In FIGS. 1–3 iris unit 28B is shown with its leaves 46 in a half-closed position so that beam 18 is colored by the second primary color around the outer portion of the beam from the periphery of the beam to about half the radius of the beam while the remaining center portion centered about beam axis 20 is uncolored. Iris unit 28C is shown in about a three-quarters closed position with beam 20 colored with the second primary color about three-fourths of the radial distance from its periphery with about one-fourth of the radial distance from beam axis 20 uncolored. In FIG. 3 leaves 46 of each control unit 28B and 28C are indicated as the control units themselves for purposes of illustration so that the positions of the leaves in each position can be seen. Iris unit 28D is shown in a completely closed position.

When the selected control plate 34A–34D is rotated, thrust pin 50 is pressured by the side walls of elongated control slot 52 from its former position relative to its support plate 30A–30D to a new position. In general, thrust pins 50 are positioned proximate apertures 42A–42D when leaves 46 are in their closed mode as shown for control plate 34A in FIGS. 1 and 2 and are positioned distant from apertures 42–42A when leaves 46 are in their closed mode as shown for control plate 34A in FIG. 3. In the intermediate positions, thrust pin 50 is forced to intermediate positions between the proximate and distant positions just discussed from the control plate aperture so that leaves 46 are positioned partly across beam 20.

Figure 5:
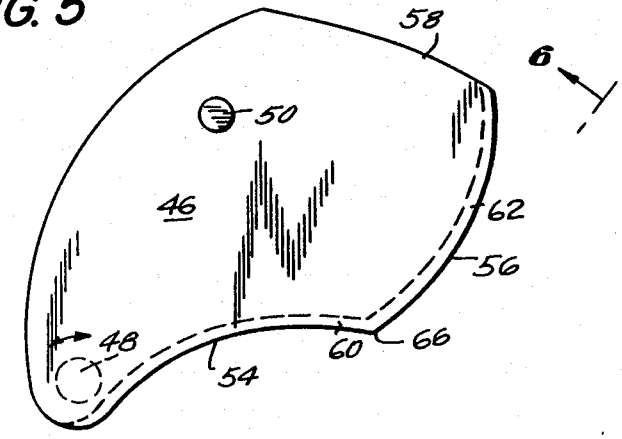
FIG. 5 is an isolated top view of one of the three leaves of the iris units.
Figure 6:
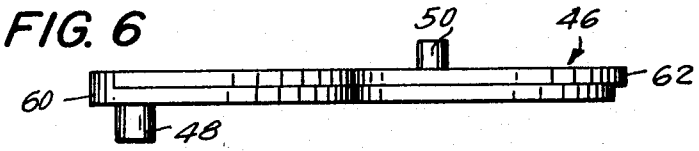
FIG. 6 is a side view of the leaf in FIG. 5 taken through line 6—6.

The exact configuration of leaves 46 is illustrated in FIG. 5. An inwardly curved wall 54 of each leaf 46 aligns with apertures 42A–42D when in the completely open mode, and in the closed mode inwardly curved wall 54 fits against an outwardly curved wall 56 of the adjoining leaf. Another outwardly slightly curved wall 58 is pressed against a portion of a support boss 38 when leaf 46 is in its open mode. Two of leave 46 have projecting edges, or lips, 60 and 62 along walls 54 and 56, respectively. In the leaf shown in FIG. 5, lips 60 and 62 project from the beam-facing surface of leaf 46, but its mating leaf in the closed mode has its lips projecting from the reverse surface so that the lips lock. The third leaf 46 has a middle lip 64, seen best in FIG. 2, projecting from walls 54 and 56 so that the lips from the other two leaves fit above and below lip 64. The three leaves 46 converge at a central point 66 aligned with beam axis 20 at the juncture of walls 54 and 56 when the three leaves 46 are in their fully closed mode. The number of leaves for each iris unit may vary from the three leaves shown herein. The leaves may be made any of a variety of materials including colored plastic material or colored glass with a metal support trim.

Figure 7:
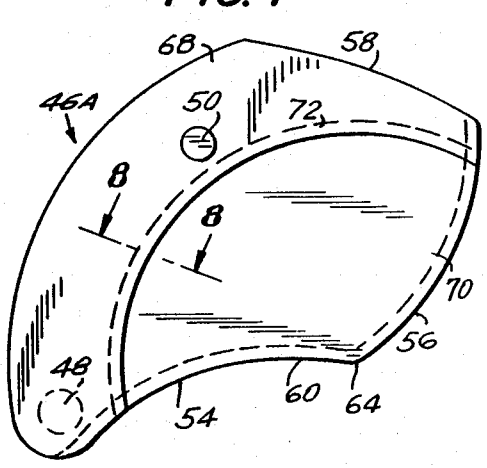
FIG. 7 is a front view of a leaf having a mounting portion and a translucent portion.
Figure 8:
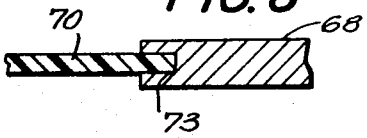
FIG. 8 is a sectional view taken through line 8—8 in FIG. 7.

FIGS. 7 and 8 illustrate an alternate embodiment of a leaf indicated as leaf 46A, which includes a mounting portion 68 and a translucent portion 70. Mounting portion 68 is made of a stronger material than translucent portion 70. Mounting portion 68 is never positioned so as intercept light rays 20. Mounting portion 68 and translucent portion 70 are joined along an annular juncture 72, which is aligned with the circular edge of circular apertures 42A–42D of control plates 34A–34D when the leaves are in their closed mode. Mounting portion 68 has an annular slot 73 along the concave side of juncture 72 that is adapted to slidably position the convex side of translucent portion 70. Mounting portion 68 and translucent portion 70 are cemented together.

Figure 9:
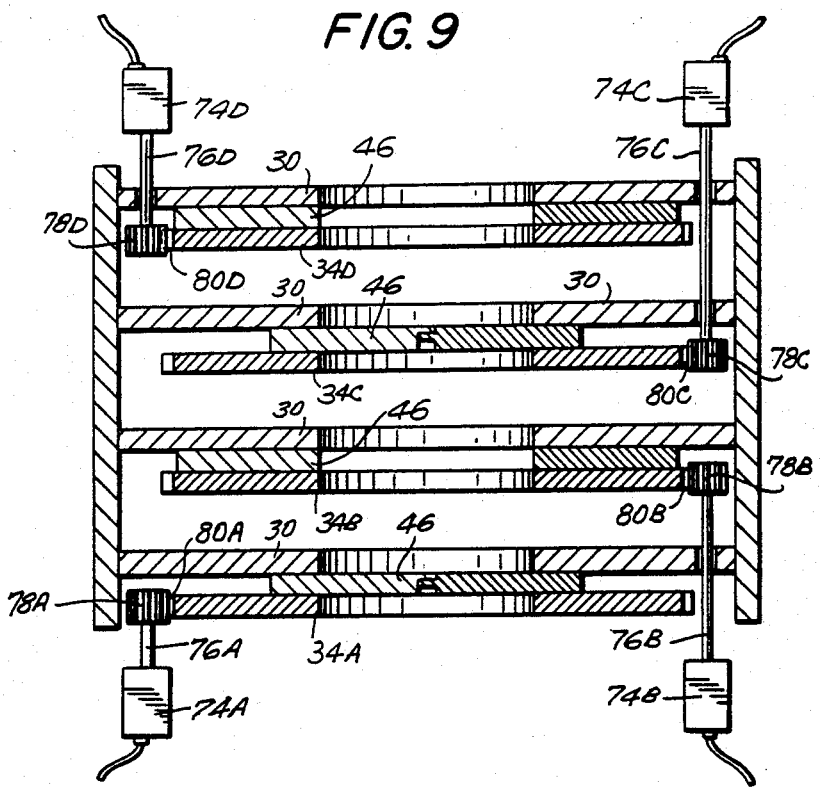
FIG. 9 is a simplified view of an alternative embodiment of the invention similar to the view shown in FIG. 2 showing the control plates controlled by drive gears of motors.
Figure 10:
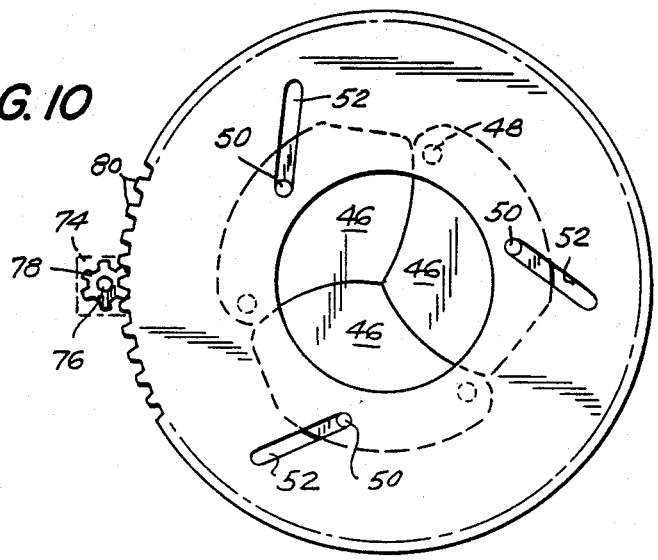
FIG. 10 is an isolated view of a single control plate controlled by a drive gear connected to a motor.

FIGS. 9 and 10 illustrate an alternative embodiment of the controls for control plates 34A–34D to control handles 44A–44D discussed earlier. FIG. 9, which is a slightly simplified version of the view shown in FIG. 2, shows four motors 74A–74D with their drive shafts 76A–76D, respectively, connected to drive gears 78A–78D, respectively, which are geared to gear teeth 80A–80D of control plates 34A–34D, respectively. FIG. 10 illustrates a typical control system for a typical control plate 34 having gear teeth 80 over a portion the circumference of the control plate. A motor 74, shown in phantom line, rotates drive shaft 76 and drive gear 78 at the end of the drive shaft. Drive gear 78 is geared to gear teeth 80. Controls for each motor lead to a control panel (not shown) so as to give the operator the ability to control all the iris leaves 46 operated by control plates 34A–34D.

Figure 11:
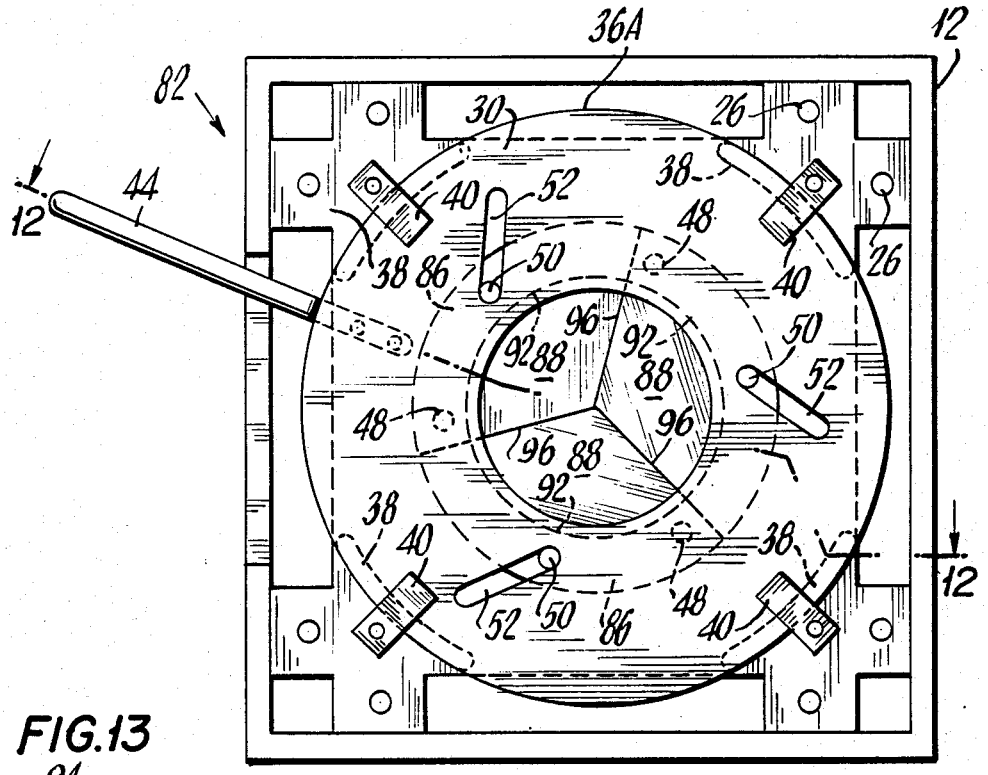
FIG. 11 is an elevational view of one side of a single iris unit having three leaves each analogous to the leaf illustrated in FIGS. 7 and 8.
Figure 13:
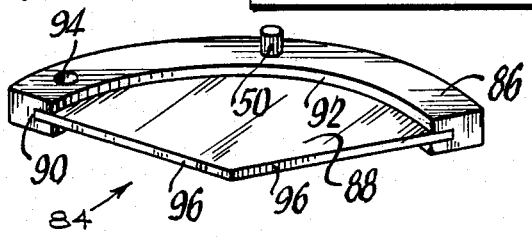
FIG. 13 is a perspective view of a single leaf of the type of leaf illustrated in FIGS. 7, 8, 11, 12, and 13.
Figure 12:
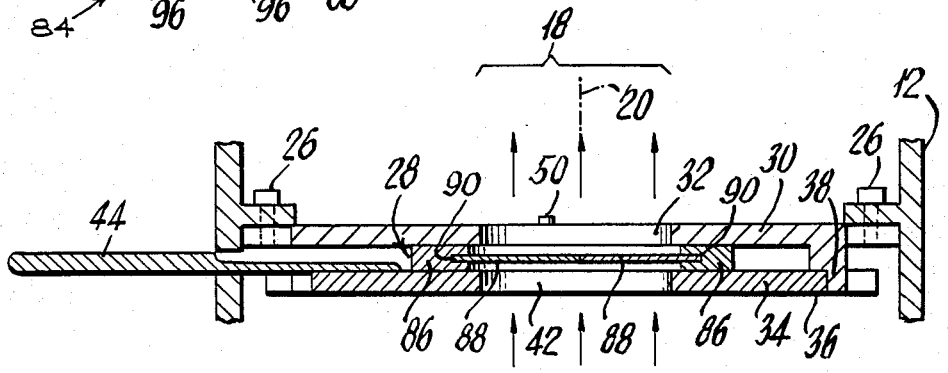
FIG. 12 is a view taken through line 12—12 of FIG. 11.

Another embodiment of the invention illustrated in FIGS. 11 and 12 as color changer system 82, which is analogous to color changer system 10. Color changer system 82 is shown as having one iris unit 42 rather than the four iris units 42A–42D of color changer system 10 by way of illustration only. Color changer system 82 includes three leaves 84 a type of leaf 84 illustrated in isolation in FIG. 13. Each leaf 84 has features analogous to leaf 46A shown in FIGS. 7 and 8. Each leaf 84 includes a mounting portion 86 and a translucent portion 88. Mounting portion 86 is thicker than translucent portion 88 and is sufficiently strong to support translucent portion 88. Mounting portion 86 supports translucent portion 88. Figure 11 illustrates three leaves 84 in the closed mode of the system with translucent portions 88 of all three leaves 84 positioned across aperture 42 fully intercepting light beam 18. Mounting portion 86 is configured as a circumferential arc with all three mounting portions 86 configured as a circumferential ring in the closed mode of color changer system 82 as illustrated in FIG. 11. Mounting portion 86 forms an arced slot 90 in which the arced circumferential edge of translucent portion 88 is positioned. Translucent portion 88 is further secured to mounting portion 86 by any of various cementing mediums known in the art. The inner rim 92 of mounting portion 86 is aligned with the circular edge of circular aperture 42 of control plate 34 and of circular aperture 32 of support frame 30 when leaves 84 are in their closed mode so that mounting portions 86 do not intercept light beam 18. Leaf 84 has a circular hole 94 which is for accepting a pivot member 48 and also has a thrust pin 50 for slidable mounting within control slot 52. Each translucent portion 88 has straight edges 96 that extend at a 120° angle from one another and that meet other straight edges 96 of other translucent portions 88 in the fully closed mode illustrated in FIGS. 11 and 12.

The embodiment of the invention particularly disclosed and described herein above is presented merely as an example of the invention. Other embodiments, forms, and modifications of the invention coming within the proper scope and spirit of the appended claims will, of course, readily suggest themselves to those skilled in the art.

What is claimed is:

1. A color changer system mounted in a luminaire that contains at least one light source emitting a beam of white light and one lens, said beam having a cross-sectional axis and said luminaire having a beam emission and, comprising, in combination, at least one support means mounted in said liminaire and having an aperture which passes said beam of white light, iris means connected to said support means, said iris means being for coloring said beam of white light and being movable between an open position and a closed position including a plurality of intermediate positions between said open and closed positions, wherein in said open position the beam of white light passes said iris means uncolored by said iris means and in said closed position the beam is fully colored, and wherein in said plurality of intermediate positions said iris means during movement between said open and closed positions is successively positioned across portions of the beam extending from the periphery of the beam to positions spaced from the axis of the beam, said iris means comprising at least one iris unit having a plurality of colored, translucent leaves centered about and disposes transverse to the beam axis, each of said leaves being positioned between said support means and said contol plate, and being rotatably mounted to said support means by a pivot member, each of said plurality of leaves being simultaneously rotatable about each said pivot member, such leaf of said plurality of leaves including an arced circumferential edge, control means connected to said iris means and said at least one support means, said control means being for selectively positioning said iris means at any of selected open, closed, or intermediate positions, said control means including a control plate supporting said at least one iris unit, said control plate forming another aperture aligned with said aperture of said support means, said control plate being rotatably connected to said support means, each of said plurality of leaves being slidably connected to said plate for rotation of said leaves as said plate is rotated, and mounting means connected to said circumferential edge of each of said plurality of translucent leaves, said mounting means supporting each of said plurality of translucent leaves, and said mounting means includes a plurality of arced mounting portions connected to said plurality of translucent leaves, each mounting portion of said plurality of mounting portions being thicker than said translucent portions, with each said mounting portion having an inner arched rim and an arced slot opening at said inner arced rim, and said translucent leaf being positioned in said arched slot.

2. The color changer system according to claim 1, wherein said plurality of arced mounting portions are slidably mounted between said control plate and said support means.

3. The color changer system according to claim 2, wherein said aperture has an outer circular edge and said inner arced rim of each said mounting portion being generally aligned with said outer circular edge when said color changer is in said closed position.

4. The color changer system according to claim 1, wherein each translucent leaf of said plurality of translucent leaves having a pair of inwardly extending linear walls which are closely aligned with other walls of the other or said plurality of translucent leaves when the color changer is in said closed position and which are withdrawn away from said aperture of said support means and said another aperture of said support plate when the color changer is in said open position.

5. The color changer system according to claim 4, wherein said each color of said plurality of leaves includes the primary colors wherein the colors of the color spectrum can be duplicated. said open position.

6. The color changer system according to claim 4, wherein said pair of inwardly extending walls include an inwardly curved wall and an outwardly curved wall which are closely aligned with an outwardly curved wall and an inwardly curved wall, respectively, of the other of said plurality of translucent leaves when the color changer is in said closed position.

7. The color changer system of claim 6, wherein said aperture of said support means and said another aperture of said control plate are circular apertures of the same diameter having centers aligned with the beam axis.

8. The color changer system of claim 6, wherein said control means further includes a control handle connected to said control plate, said control handle extending beyond said luminaire, whereby an operator has access to the control handle to rotate said control plate and said iris unit to a selected position.

9. The color changer system of claim 6, wherein said control means further includes said control plate having a circumferential portion having gear teeth, a motor mounted in association with said luminaire, a drive shaft extending from said motor to said control plate, a drive gear positioned at the end of said drive shaft and geared with said gear teeth, wherein when said motor is activated, said drive gear rotates said control plate so as to open or close said iris unit to a selected position.

10. The color changer system according to claim 1, wherein said at least one support means includes a plurality of support means, said iris unit includes a plurality of iris units each spaced proximate one another and centered about the beam axis, and said control plate includes a plurality of control plates.

11. The color changer system according to claim 10, wherein each of said plurality of iris units have a plurality of leaves of the same color for each of said iris units, each said plurality of leaves of one iris unit being of a different color from the plurality of leaves of the remaining others of said plurality of said iris units.

12. The color changer system of claim 10, wherein each of said plurality of said iris units is positioned between said support means and said control plate.

13. The color changer system according to claim 10, wherein each of said plurality of leaves has a first side surface and a second reverse side surface and has a pivot connected to said first side surface rotatably mounted to said support means, whereby said plurality of leaves are rotatably movable about said pivot between said open and closed positions.

14. The color changer system according to claim 13, wherein each of said plurality of leaves includes a thrust pin extending transversely from said second side surface of each of said plurality of leaves, and said control plate has a plurality of elongated slots having opposed ends, each said thrust pin being engaged in and slidably movable along said slot during rotation of said control plate about each said pivot to selected positions between or at said opposed ends which correspond to said open and closed modes.

15. The color changer system of claim 14, wherein said plurality of leaves of each said iris units includes three leaves.

* * * * *